US006322461B1

(12) United States Patent
Walsh

(10) Patent No.: US 6,322,461 B1
(45) Date of Patent: Nov. 27, 2001

(54) BASEBALL PITCHING TARGET

(76) Inventor: Stephen Paul Walsh, 38C Putnam Green, Greenwich, CT (US) 06830

( * ) Notice: Subject to any disclaimer, the term of this patent is extended or adjusted under 35 U.S.C. 154(b) by 0 days.

(21) Appl. No.: 09/548,693

(22) Filed: Apr. 13, 2000

(51) Int. Cl.[7] ..... A63B 69/00

(52) U.S. Cl. ..... 473/422; 473/454; 273/407; 273/348

(58) Field of Search ..... 273/317.6, 108.3, 273/108.31, 127 B, 127 C, 127 R, 402, 400, 406, 410, 394, 396, 398, 397, 371, 374, 348, 407; 473/417, 421, 422, 476, 445, 446, 453–456, 465, 468, 431, 432, 197, 439; D21/304, 305, 698, 780; 124/6, 7; 248/156, 219.1

(56) References Cited

U.S. PATENT DOCUMENTS 1,220,980 * 3/1917 Griesel ..... 273/317.6
1,855,568 * 4/1932 Brown ..... 273/317.6
3,415,519 * 12/1968 Hand ..... 273/407
3,542,365 * 11/1970 Gantz ..... 273/407
3,907,291 * 9/1975 Parker ..... 473/445
4,168,062 * 9/1979 McCarthy et al. ..... 473/446
5,277,432 * 1/1994 Bateman ..... 273/407
5,676,378 * 10/1997 West ..... 273/390
5,695,196 * 12/1997 Yanosky ..... 273/392
5,725,217 * 3/1998 White ..... 273/407
5,967,523 * 10/1999 Brownlee ..... 273/407

* cited by examiner

*Primary Examiner*—Sebastiano Passaniti
*Assistant Examiner*—Mitra Aryanpour
(74) *Attorney, Agent, or Firm*—Richard T. Holzmann

(57) ABSTRACT

A baseball pitching target having a base with a pair of vertical channels integrated thereon for insertion therein of a foldable simulated batter figure. To maintain the batter figure in an upright position there is behind the figure, also integral with the base, a vertical hollow main frame for receiving therein a tube adjustable in height with a back support/hook assembly at its upper end for attachment to the extended batter figure. This main frame also has an upper shoulder having a pivot thereon for insertion of a hole thereabout at one end of a swingable spring-loaded arm further having a glove target at its other end. Thus, all the player sees is the batter figure without distracting elements, adjustable in height to define a strike zone, and a glove target attached to an arm swingable when hit and automatically returnable to its original position.

7 Claims, 7 Drawing Sheets

BASEBALL PITCHING TARGET

FIELD OF THE INVENTION

This invention relates to a game and training apparatus, and more particularly to a baseball pitching target.

BACKGROUND

Baseball pitching targets are usually employed to develop and improve pitching control and accuracy. They are normally used by an individual player to practice his pitching. In baseball, the term "strike zone" is the vertical rectangular area through which a pitcher must throw a baseball to register a strike. The dimensions of this rectangular area are a given width and an adjustable height normally defined by the distance between the knees and the shoulders or armpits of the baseball player at bat. The height and location of the strike zone will thus vary according to a particular player's height and batting stance.

In training a player to throw accurately, a coach would prefer that he not only practice throwing at a specific point, but to practice placing the ball at various spots within the strike zone. The coach may want to force the pitcher to adapt to the real-life problems of differently sized players, right-/left-handed batters, etc. by changing the size and location of the simulated strike zone and the simulated catcher's mitt/target. Heretofore, practice devices for defining a strike zone or the receiving area of a pitched ball have generally been rigid structures with a rectangular opening. The rectangular openings define the strike zone and are usually not realistic because they cannot be adjusted to simulate the correct size and location of the zone for individual batters. Unless both the size and the location of a target's strike zone can be varied to perfectly fit different batters, both the pitchers and batters will learn improperly. The pitcher will not learn the varying limits of the strike zone for different batters, and a particular batter will not learn his own limits.

A number of U.S. patents have been granted for baseball pitching targets as an aid for improving the accuracy of a pitch. For example, U.S. Pat. No. 1,191,605 to Mertz, is a game apparatus wherein the player, i.e. the pitcher, throws a first ball and if he strikes the target properly, an impulse is imparted to a second ball or projectile, which projectile is thrown towards the player for fielding and throwing into a basket to score points. This apparatus is large in size, complex in construction having weights, pulleys and the like and with no batting figure. Furthermore, for pitching practice alone it is unnecessary to have the ball returned to the pitcher.

U.S. Pat. No. 3,658,329 granted to Ciccarello, is a swingable strike zone baseball device which has an outline in the shape of a baseball figure with a full rectangular strike zone attached thereto. This strike zone is bounded by rods which rods when hit by the force of the ball will swing the strike zone (the "gate") away from the pitcher. The device may be provided with means to return the struck gate into planar relationship with the baseball figure. It is therefore, only when the periphery of the strike zone is hit is the gate activated thereby only grossly defining the target. Furthermore, there is no means to adjust the height of the gate for different heights or for the positional aspects of the batter.

Mahieu was granted U.S. Pat. No. 4,629,188 whose target is of window shade-like construction of a constant width and variable height equal to that of the strike zone having the impression of a catcher thereon and affixed to vertical telescopic pipes whose height can be adjusted to accommodate batters of varying dispositions. The inventor points out that the device can only be used with a soft or plastic ball since, "A hard ball would not be appropriate because it could crash through the target." Such a soft ball would hardly simulate an actual pitcher's delivery. Furthermore, there is no swing arm and it is merely a display, U.S. Pat. No. 5,433,434 to Helmetsie is designed not only as a baseball pitcher's target but also as a target for soccer or lacrosse. Consequently, it involves what amounts to a soccer goal and net with a strike zone suspended in the central portion by means of elastic supporting cords. The strike zone may also embody a catcher's mitt-like target for more accuracy. However, the larger goal zone, the elastic cords and the nature of the strike zone structure are deemed to be highly distracting to a baseball pitcher who is striving for precision throwing.

Finally, U.S. Pat. No. 5,566,935 granted to Meharg discloses an inflatable batter dummy having an accordion-like structure allowing it to be shortened or lengthened to accommodate various sized batters. Fluorescent stripes thereon can identify the height of the strike zone, while a depiction of a home plate on a mat defines the width thereof. There is neither any attempt to embody a swinging arm action, nor a precisely located target nor a home plate clearly visible to a batter.

As a result of the deficiencies associated with the prior art, the applicant invented the apparatus described in detail below.

It is therefore, a primary object of the invention to provide a novel baseball pitching target which is inexpensive to manufacture, yet durable and safe to use.

It is a further objective to provide such a device which can be set-up by one person in a few minutes without special tools.

It is yet another object to provide a baseball pitching target having an adjustable strike zone that is variable in height to realistically represent the strike zone for a particular sized batter.

It is an additional object to provide a simulated catcher's mitt which not only more precisely defines the target for practice rather than the entire strike zone, but when hit swings backward and automatically resets to the original position.

It is still another object to have the device reversible so that either a right-handed or left-handed batter can be displayed.

It is a final object to provide a life-size image of a batter to realistically create the home plate environment without distractions and which image can be folded to a smaller size for ease of transport and storage.

SUMMARY OF THE INVENTION

A baseball pitching target apparatus comprising: a base; a pair of guide channels integral with the base and extending vertically therefrom for slidably receiving a foot board; a rigid support member integral with the base and extending vertically therefrom, said support member having an opening therein for receiving a tubular member vertically adjustable in effective height; and a simulated baseball figure panel for insertion into said guide channels and held erect in position by a back support assembly at the upper end of said adjustable tubular member. The target apparatus further comprises a simulated glove target mounted upon a swingable spring-loaded arm movably attached to said rigid support member, said glove target yielding to the impact of a thrown baseball and then recovering its original position through the urging of a spring device. Said baseball figure panel has affixed thereto an image on both sides which panel may be reversed to simulate right- or left-handed batters and wherein said panel has a fold(s) therein for reducing its size for easier packaging and transport.

The target apparatus wherein said baseball figure panel having a slot therein its upper portion for receiving said back support assembly attached to upper arm of adjustable tube further comprising a hook for insertion into said slot using the back supporting portion of back support assembly to retain baseball figure panel in its raised position. Said spring device has a first hook at one end for insertion through a loop on swinging arm, and a second hook at the other end for insertion into one of two loops attached to opposite sides of said rigid support member for supporting glove target in position for either a right- or left-handed batter respectively.

The height of said baseball figure panel may be adjusted approximately within ±6 inches to control height limits of an imaginary strike zone as reflected in the height of different batters, while width limits of said zone is determined by the width of the home plate element provided.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there is shown in the drawings embodiments which are presently preferred. It should be understood however, that the invention is not limited to the precise arrangements and instrumentalities shown. In the drawings.

DESCRIPTION OF THE PREFERRED EMBODIMENTS

The instant invention was designed to present a more realistic life-like target to the baseball pitcher while practicing his pitching without the distracting elements normally present in these kinds of targets. All the pitcher sees is the simulated batter, a precisely located glove target and a home plate. Since the target swings backward upon being struck, the pitcher can clearly discern that the target was hit. Furthermore, having a precisely located fixed glove target one may aim for positions such as 2 o'clock, 8 o'clock, and the like with respect to the fixed target to allow further additional precision without the need to grossly complicate the structure by moving the target about. The ability of the target to automatically swing forward to its original position allows the batter to continue pitching without interruption. Meanwhile, the presence of an official-sized home plate defines the horizontal limits of the strike zone, while the adjustability of the height of the batter image defines the vertical component thereof. In addition, the design allows it to be transported, set-up most anywhere and operated by the player alone. Fabrication of the device is relatively simple, being also lightweight and relatively inexpensive.

Figure 1:
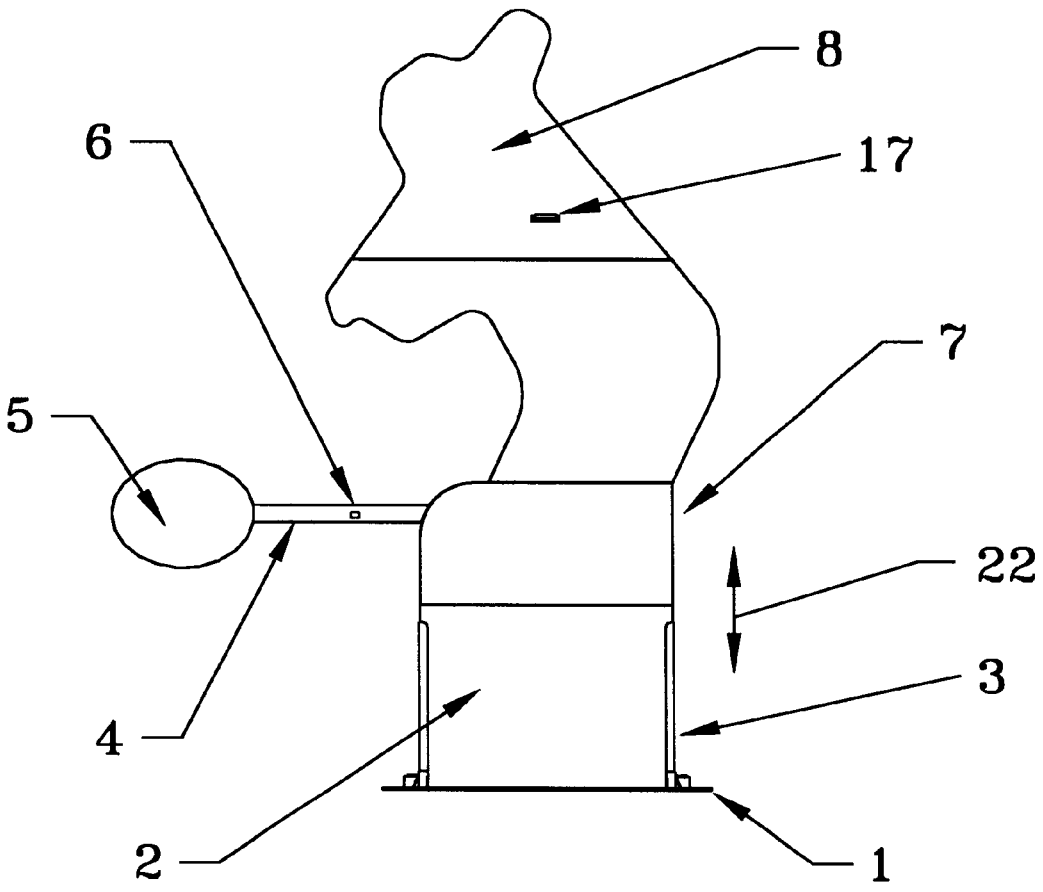
FIG. 1 is a front view of the assembled baseball pitching target.
Figure 7:
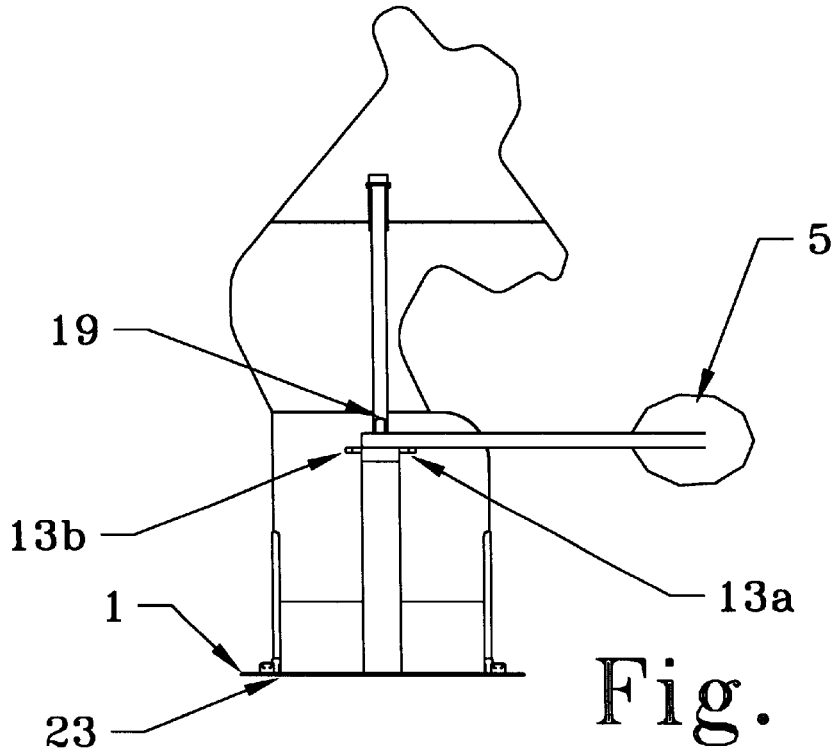
FIG. 7 is a rear view of FIG. 1.

In FIG. 1 is shown, in a front view of the assembled invention, a reversible simulated batter FIG. 7, preferably of molded plastic, inserted into a pair of vertically placed channels or guides 3 fixed to the front corners of plastic molded base 1. Also inserted into these guides 3, preferably of plastic or aluminum, is a reversible footboard 2 for holding the batter FIG. 7 in place. Both the batter FIG. 7 as well as the footboard 2 may have a picture 8 (not shown ) printed or painted thereon of a player of interest to the pitcher. These two components are reversible so as to present to the pitcher either a left- or right-handed batter 7 to introduce a more realistic element into the design and to create a more life-like atmosphere. Also depicted is a swinging arm 4 having a loop 6 thereon said arm 4 one end of which is connected to base 1 the other end of which has a glove target 5 thereon. Element 17 represents a slot in baseball FIG. 7 for allowing insertion therein of a support mechanism (illustrated and described below), while 22 shows the vertical direction of movement of baseball FIG. 7 to present to the pitcher differing strike zones reflecting the height of different batters.

Figure 2:
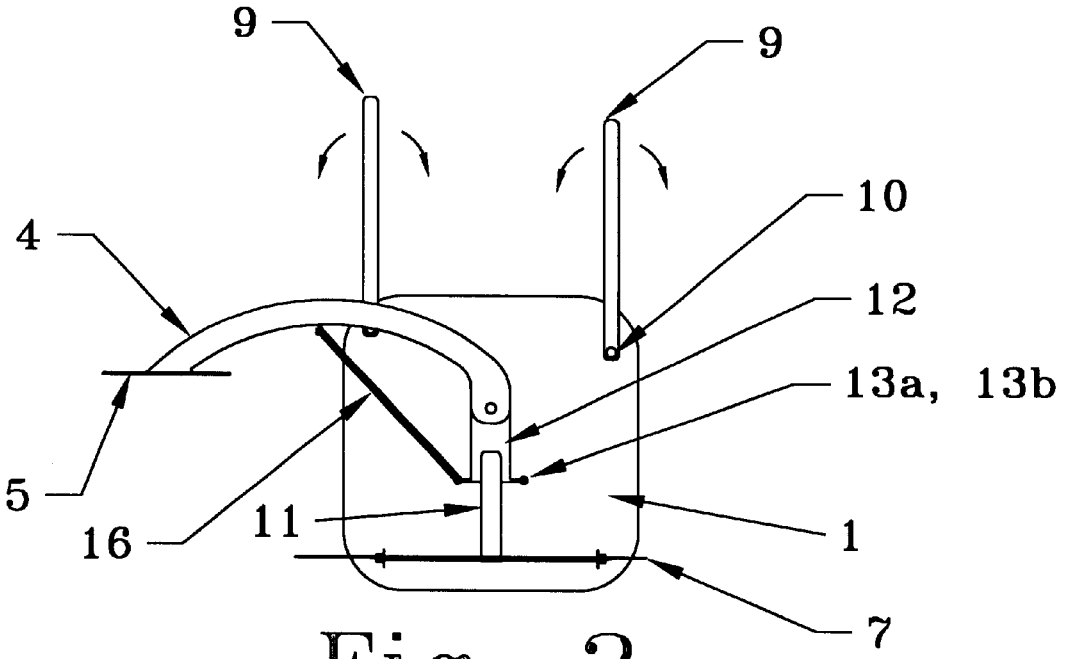
FIG. 2 is a top view of FIG. 1.
Figure 3:
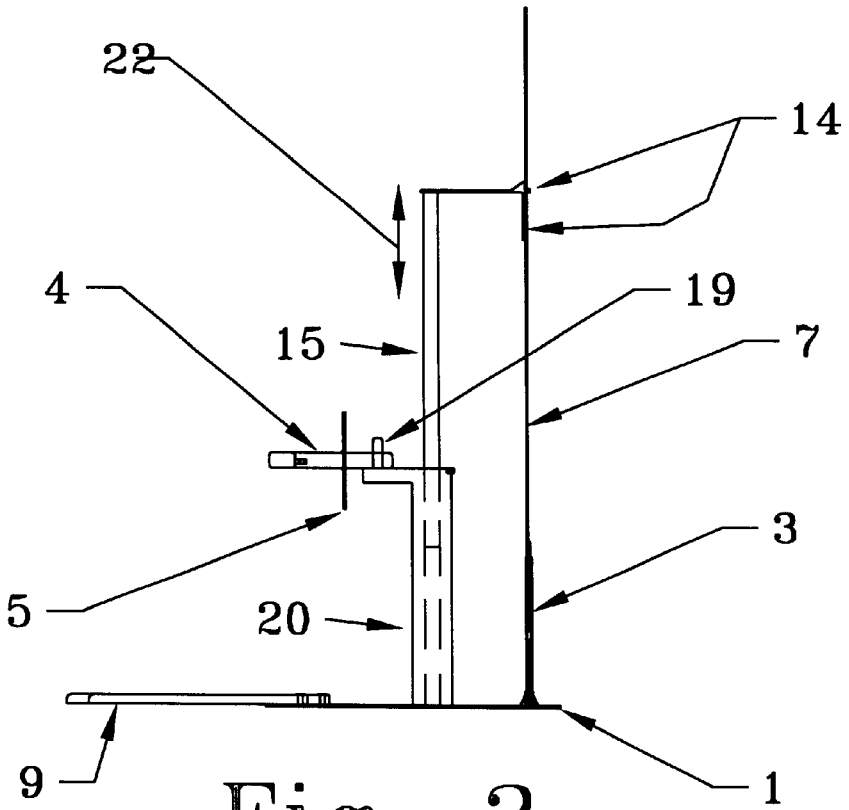
FIG. 3 is a side view of FIG. 1.
Figure 8:
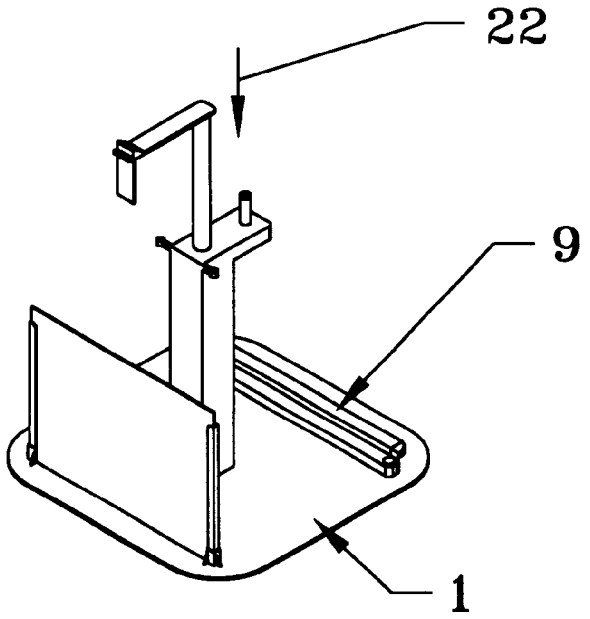
FIG. 8 is a right-hand front isometric view of the base and the baseball figure support mechanism without the baseball figure and the swinging arm.

A top view of FIG. 1 illustrated in FIG. 2, shows a pair of folding legs 9 connected to a pair of pivots 10 situated on the back corners of base 1 for providing backward motion stability to the complete structure especially when the target is struck by a fast-moving baseball. These legs 9, attached to pivots 10 may be folded back onto the base for ease of storage and transport as shown in FIG. 8. Turning to FIG. 3 for the moment, a side view of FIG. 1, element 20 represents a main member having an opening running therethrough and having a shoulder 12 with a pivot 19 thereon for placement of hole 21 of swinging arm 4 thereabout.

Fabricated integrally with base 1 is member 20 whose purpose is not only to support swinging arm 4 but also to retain in the opening therein movable tubular member 15 which latter member has at its upper end arm 11 being a portion of back support/hook assembly 14 for placement in slot 17 of reversible folding batter FIG. 7 thereby allowing batter FIG. 7 to be supported in an upright position. Tube 15 can be raised or lowered about ±6 inches to present to the pitcher a strike zone of varying height to approximate the height of different batters. Once the height is set, a thumb turn or lock screw (not shown) can be tightened to hold the batter FIG. 7 in place.

Returning to FIG. 2 is shown loaded spring or bungee cord 16 whose first hook at the one end is inserted through loop 6 on arm 4, and whose second hook at the other end is inserted either into one of the pair of loops 13*a* or 13*b* situated on the upper portion of member 20 depending upon whether the batter is set-up as left- or right-handed. Main frame 20 is fixed vertically to base 1 and is either integrally molded with base 1 or attached thereto with bolts.

Figure 4:
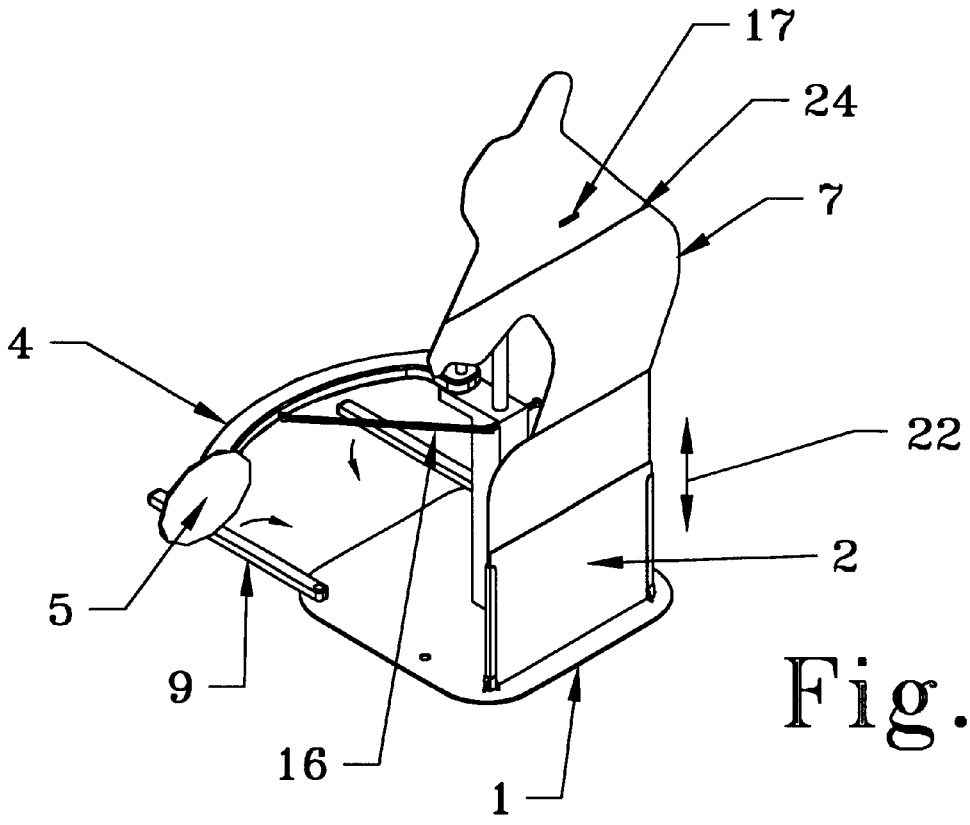
FIG. 4 is a right-hand front isometric view of FIG. 1.
Figure 5:
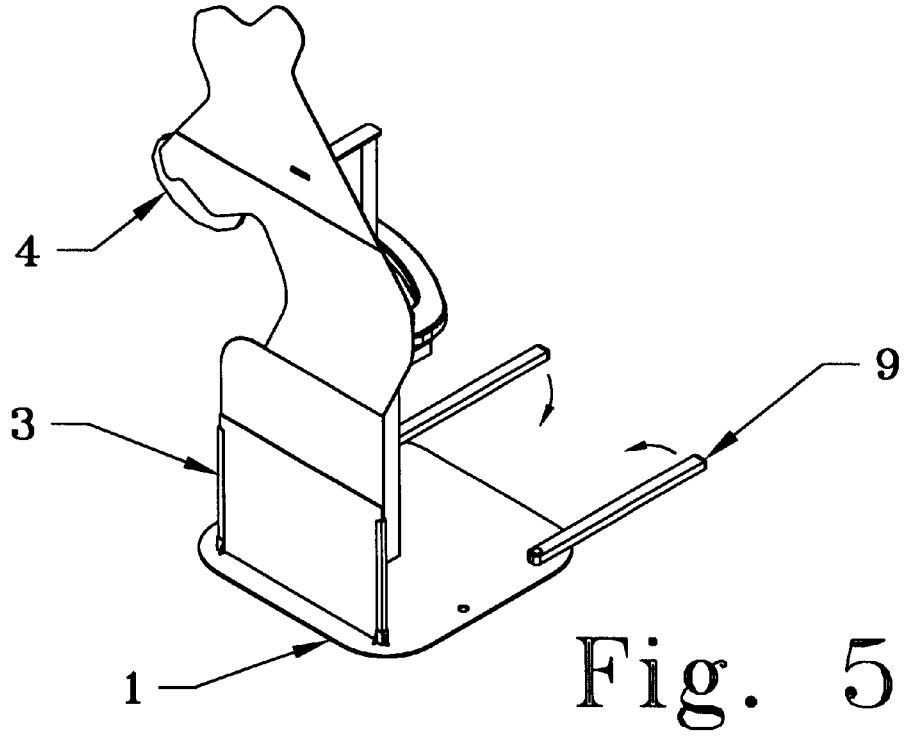
FIG. 5 is a left-hand front isometric view of FIG. 1.
Figure 6:
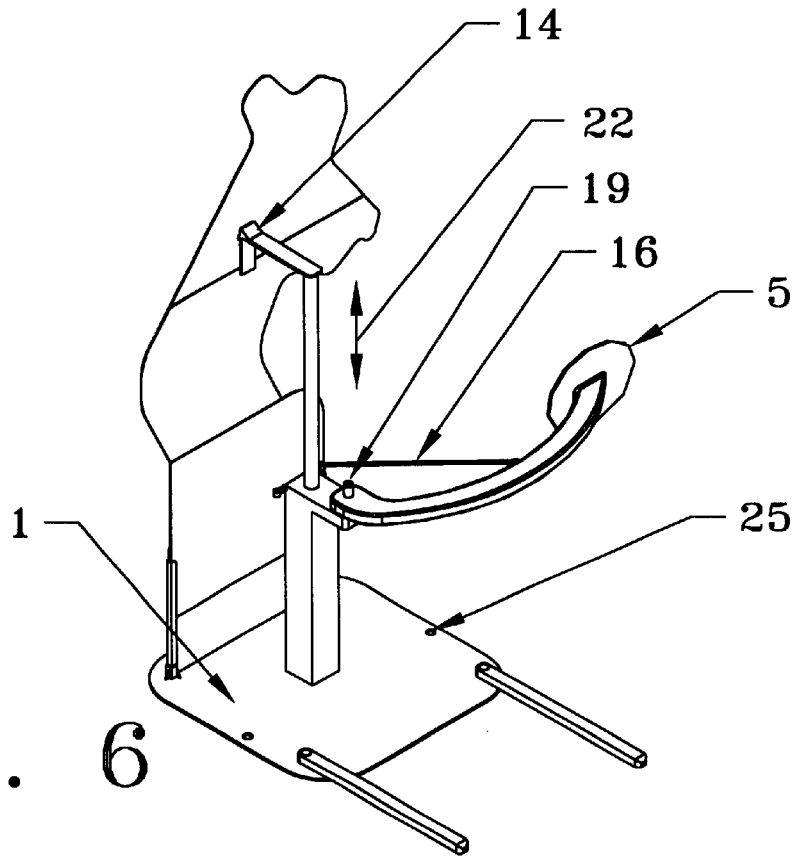
FIG. 6 is a right-hand rear isometric view of FIG. 1.

FIGS. 4, 5 and 6 are isometric right-handed front, left-handed front and right-handed rear views respectively of the assembled invention. FIG. 4 introduces element 24 which is a folding edge or so-called living hinge of batter FIG. 7 for reducing the overall size for storage and transport. While two such living hinges are shown in the drawings, more or less may be incorporated to suit the packaging requirements. FIG. 6 illustrates the location of holes in base 1 for insertion of spikes 28 for increased stability as required. FIG. 7 is a rear view of the assembled invention highlighting non-skid strips 23 affixed to the bottom of base 1 to provide additional stability.

Figure 9:
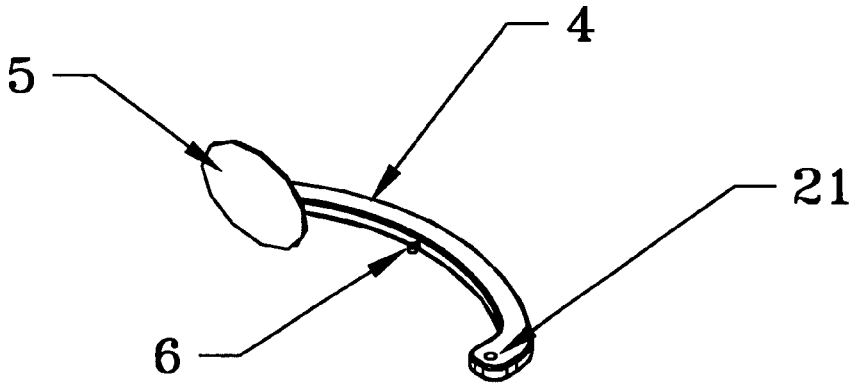
FIG. 9 is a front isometric view of the arm.
Figure 10:
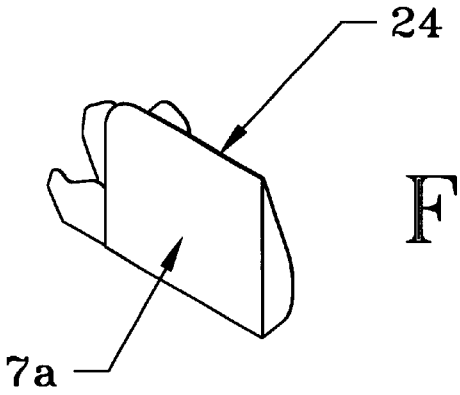
FIG. 10 is an isometric view of the baseball figure in the folded position.

FIG. 8 is an isometric right-handed view of base 1 and the batter FIG. 7 support features without arm 4 and glove target 5. This stripped-down version with legs 9 folded in and movable tube 15 at its lowest height or separately laid on its side, makes packaging and transport simple. FIG. 9 is a front isomertric view of arm 4, while FIG. 10 is an isometric view of folded baseball FIG. 7*a* in its foldaway position. The two fold locations in batter FIG. 7 are clearly shown but not numbered in FIG.1 as well as in several other figures. These folds can be molded into 7 being flexible enough to embody so-called "living" hinges. On the other hand, one might wish to mount conventional hinges rather than the folds if excessive useage is indicated to provide a sturdier product. Furthermore, one may prefer that batter FIG. 7 be made of wood, as an example, to make the image more attractive and durable when printed or painted thereon; mechanical hinges could then be employed.

Figure 11:
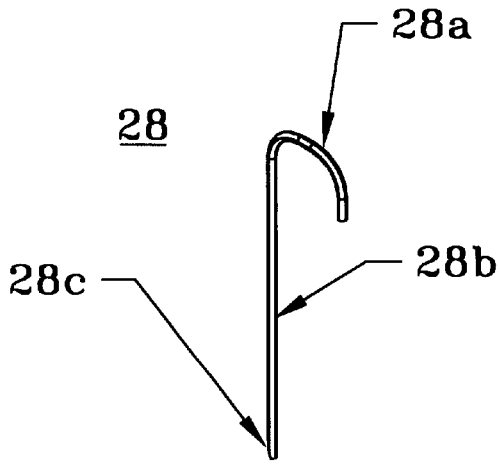
FIG. 11 is a view of a spike.
Figure 12:
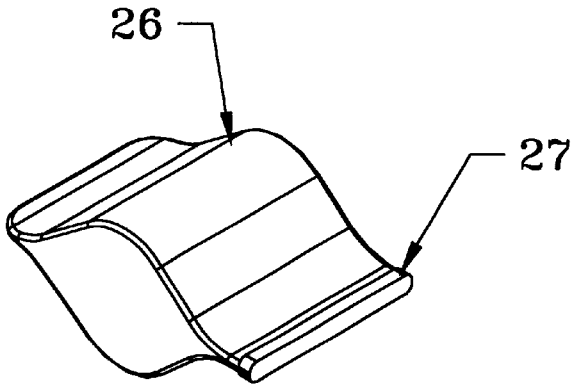
FIG. 12 is a front isometric view of a weight bag.
Figure 13:
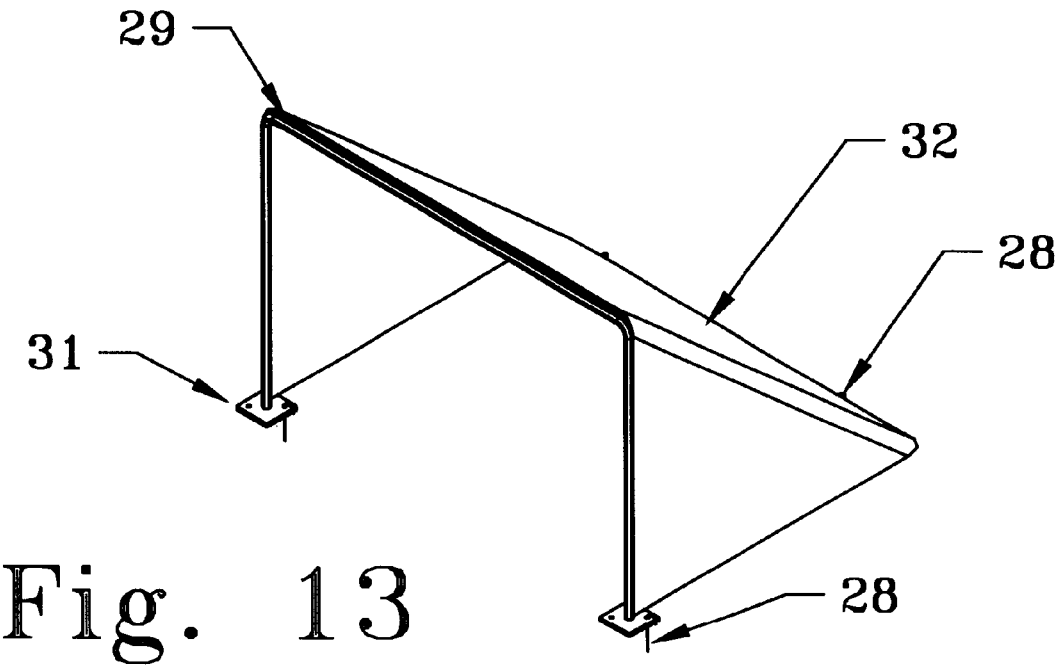
FIG. 13 is a front isometric view of a back-up net to catch a thrown ball.
Figure 14:
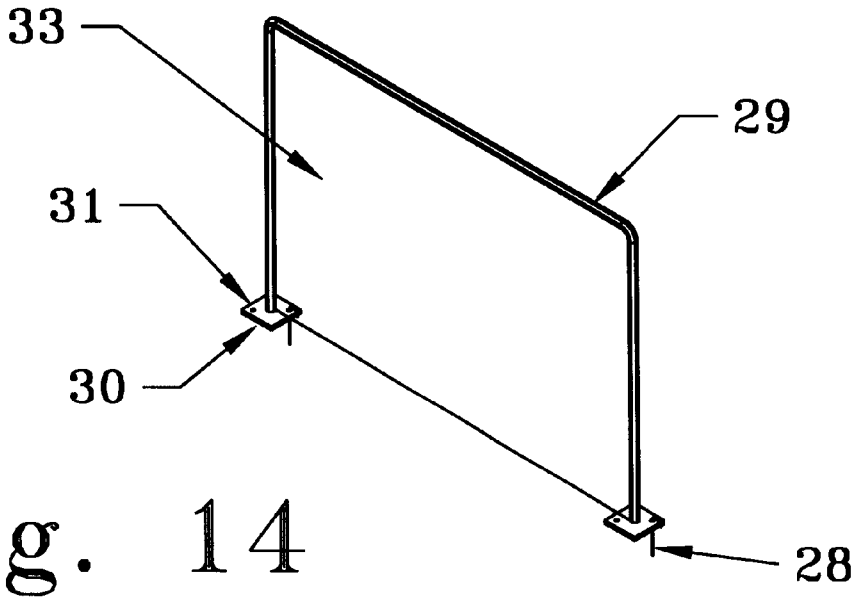
FIG. 14 is a front isometric view of a back-up spring-loaded net to return a thrown ball.

FIG. 11 shows a typical spike 28 for holding down base 1 as well as net 32 of FIG. 13 and base plates 30 of FIG. 14. Spike 28 has a hook 28*a* at its upper end, a pointed tip 28*c* at its lower end and a shaft 28*b* therebetween. FIG. 12 illustrates a typical weight bag 26 with a Zip-Lock type of closure 27, for example, which may be filled with sand or water to be placed on top of base 1 for further support if necessary due to the nature and condition of the ground and soil in the one case,or, in another situation, for use of the baseball pitching target indoors.

FIGS. 13 and 14 are front isometric views of back-up nets to stop a thrown ball. The former is merely to catch a ball using net frame 29 with net 32 attached thereto, the net being held down with spikes 28 while the frame is held in place with base plates 30 having holes 31 therein also fixed to the ground with spikes 28. The latter net 33 is a spring-loaded tight net which will return the ball to some extent when struck.

Assembly of this baseball pitching target is relatively simple. The stored device consists of four units as follows: (1) base 1 having integrated therewith legs 9 folded backwards thereon, main frame 20 integral with 1 already in place, and guides 3 also integral with 1 in place containing reversible footboard 2 therein; (2) adjustable tube 15 either reduced to minimum height or laid alongside (1) above; (3) swinging arm 4 also laid alongside; and (4) reversible foldaway batter FIG. 7 placed conveniently within the container.

Base 1 with its associated parts is placed in a proper location with legs 9 extended, tube 15 is either inserted into main frame 20 or raised as the case may be, batter FIG. 7 is unfolded and the bottom thereof is inserted into guides 3, the height of tube 15 is set with a thumb turn or lock screw, and the hook of back support/hook assembly 14 is placed into slot 17 of batter FIG. 7. Next, swinging arm 4 is placed on pivot 19 and loaded spring or bungee cord 16 hooks are attached to the respective loops 6 and 13*a* or 13*b* to provide the proper swingability for either right- or left-handed batters.

Auxiliary items such as a framed net for insuring that thrown balls do not go astray, and a regulation sized home plate, having sufficient thickness so as it can be seen by the pitcher, for identifying the horizontal strike zone limits are also a part of any complete baseball pitching target.

Climate may also influence the best mode embodiment designed for relatively infrequent use and thus the need for disassembly, storage and transport. In a dry relatively mild climate an embodiment having holes at the corners of the base for insertion of spikes to maintain it either in a permanent or semi-permanent location is also emcompassed in the scope of the instant invention. So too for an additional embodiment for use indoors in inclement weather, for example, in a gym or recreation hall, wherein the base may be modified to allow for positioning of weights at the corners thereof to provide support for indoor use.

Thus, it is maintained that the effect produced by the present invention has been achieved, and by its structure and function the purposes and objects outlined above have been realized. The subject invention:

1. is simple in construction thereby promoting ease of manufacture and cost efficiencies in production while providing a novel baseball pitching target which is inexpensive to manufacture, yet durable and safe to use;
2. is simple to set-up without special tools;
3. presents a pitcher with a realistic image without distracting tubes, bars, ropes and the like of many prior art devices;
4. provides the pitcher with a realistic target, i.e., the simulated catcher's mitt itself rather than a precisely defined but broad strike zone target thereby promoting the development of superior pitching skill;
5. has an adjustable strike zone that is variable in height to realistically represent the strike zone for a particular sized batter;
6. provides the simulated catcher's mitt which when hit swings backward and automatically resets to the original position to clearly indicate to the pitcher that the target has been hit;
7. provides a reversible simulated batter figure so that either a right-handed or left-handed batter can be displayed;
8. provides a life-size image of a batter to realistically create the home plate environment without distractions and which image can be folded to a smaller size for ease of transport and storage; and
9. provides the young novice with an image of either his most or least favorite batter as the pitcher's mood may determine.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A baseball pitching target apparatus comprising:

a base;

a pair of guide channels integral with the base and extending vertically therefrom for slidably receiving a foot board;

a rigid support member integral with the base and extending vertically therefrom, said rigid support member having an opening therein for receiving a tubular member vertically adjustable in effective height; and a simulated baseball figure panel for insertion into said guide channels and held erect in position by a back support assembly at the upper end of said tubular member;

a simulated glove target mounted upon one end of a spring-loaded arm, said arm having a hole therein its other end, movably attached to said rigid support member, said glove target yielding to the impact of a thrown baseball and then recovering its original position through the urging of the spring-loaded arm.

2. The target apparatus of claim 1 wherein said baseball figure panel has affixed thereto an image on both sides said panel may be reversed to simulate right-or left-handed batters and wherein said panel has a fold therein for reducing its size for easier packaging and transport.

3. The target apparatus of claim 1 wherein said baseball figure panel having a slot in its upper portion for receiving said back support assembly attached to an upper arm of said tubular member further comprising a hook for insertion into said slot using a back supporting portion of said back support assembly to retain said baseball figure panel in its raised position.

4. The target apparatus of claim 1 wherein a spring-loaded mechanism of the spring-loaded arm has a first hook at one end for insertion through a loop on the arm, and a second hook at the other end thereof for insertion into one of two loops attached to opposite sides of said rigid support member for supporting said glove target in position for either a right- or left-handed batter respectively.

5. The target apparatus of claim 1 wherein the base having non-skid strips on its bottom surface further comprises a pair of pivots for supporting foldable legs attached to the portion of the base opposite said figure for enhanced stability when said glove target or said figure is struck with said baseball, as well as holes therein for receiving spikes for fixing in place to a permanent or semi-permanent surface.

6. The target apparatus of claim 1 wherein said rigid support member further comprises at its upper end a shoulder having thereon a pivot, said pivot for receiving said hole at the end opposite of said glove target of the swinging arm.

7. The target apparatus of claim 1 further comprising a home plate for determining the width of an imaginary strike zone, while the height of said baseball figure panel may be adjusted approximately within ±6 inches to control height limits of said strike zone as determined by the height of different batters.

* * * * *